US008382433B2

(12) United States Patent
Wardle et al.

(10) Patent No.: US 8,382,433 B2
(45) Date of Patent: Feb. 26, 2013

(54) METHOD FOR PRODUCING A BLADE BY CASTING AND BLADE FOR A GAS TURBINE

(75) Inventors: Brian Kenneth Wardle, Brugg (CH); Beat Von Arx, Trimbach (CH)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 13/113,630

(22) Filed: May 23, 2011

(65) Prior Publication Data

US 2011/0243756 A1 Oct. 6, 2011

Related U.S. Application Data

(63) Continuation of application No. PCT/EP2009/065189, filed on Nov. 16, 2009.

(30) Foreign Application Priority Data

Nov. 25, 2008 (CH) ..... 1837/08

(51) Int. Cl.
*F01D 5/08* (2006.01)
*F01D 5/18* (2006.01)

(52) U.S. Cl. ..... 416/96 R; 416/95 A; 416/97 R; 416/97 A; 416/192; 416/115; 416/116; 29/888.024; 29/888.025

(58) Field of Classification Search ..... 416/95, 416/96 R, 96 A, 97 A, 97 R, 191, 192; 415/115, 415/116; 29/888.02, 888.024, 888.025
See application file for complete search history.

(56) References Cited

U.S. PATENT DOCUMENTS

| | | | | |
|---|---|---|---|---|
| 4,809,764 | A * | 3/1989 | Prasad | 164/122.1 |
| 4,940,388 | A * | 7/1990 | Lilleker et al. | 416/97 R |
| 5,234,047 | A * | 8/1993 | Rose | 164/358 |
| 5,531,568 | A * | 7/1996 | Broadhead | 416/97 R |
| 5,785,496 | A * | 7/1998 | Tomita | 416/97 R |
| 7,377,746 | B2 * | 5/2008 | Brassfield et al. | 416/97 R |
| 7,958,928 | B2 * | 6/2011 | Garlock et al. | 164/122.1 |
| 2005/0126736 | A1 | 6/2005 | Bhangu et al. | |

FOREIGN PATENT DOCUMENTS

EP 1944468 A2 7/2008

* cited by examiner

*Primary Examiner* — Igor Kershteyn
(74) *Attorney, Agent, or Firm* — Volpe and Koenig, P.C.

(57) ABSTRACT

A method is provided for producing a blade, by casting, for a gas turbine. The blade includes an elongate airfoil which extends in a blade longitudinal direction, merges into a blade root at the lower end, has a shroud segment at the blade tip and is pervaded by a single cooling air channel running in the blade longitudinal direction from the blade root to the blade tip. The method includes, during the casting of the blade, the blade material being fed exclusively from the blade root into the mold provided therefor, and the cooling air channel is formed during the casting of the blade by using a single core body, which is provided, at the blade tip, with a local casting cross section increasing element.

6 Claims, 2 Drawing Sheets

METHOD FOR PRODUCING A BLADE BY CASTING AND BLADE FOR A GAS TURBINE

CROSS REFERENCE TO RELATED APPLICATIONS

This application is a continuation of International Application No. PCT/EP2009/065189 filed Nov. 16, 2009, which claims priority to Swiss Patent Application No. 01837/08, filed Nov. 25, 2008, the entire contents of all of which are incorporated by reference as if fully set forth.

FIELD OF INVENTION

The present invention deals with the field of gas turbine engineering. It relates to a method for producing a blade, by casting, for a gas turbine. It further relates to a blade for a gas turbine.

BACKGROUND

Blades of gas turbines, which are usually exposed to very high hot gas temperatures, are usually produced by casting from high-strength alloys (e.g. nickel-base alloys). During the production, use is made of molds in which the pourable alloy is introduced from the lower end of the blade, from the blade root, into the mold. By virtue of a core arranged in the interior of the mold, a cooling air channel is produced in the cast blade body, which cooling air channel runs in the blade longitudinal direction through the blade body and, for cooling purposes, can conduct cooling air from the blade root to various points of the blade.

Such a blade is shown in FIG. 1: the blade 10 shown in FIG. 1 comprises an airfoil 11 which extends in the blade longitudinal direction 25 and merges into a blade root 12 at the lower end, above which blade root there is a platform 13 which inwardly delimits the hot gas passage of the gas turbine. At the upper end, the blade 10 ends in a blade tip 14, at which there is a shroud segment 15 which outwardly delimits the hot gas passage. An upwardly protruding rib 16 running in the circumferential direction of the machine can be provided on the top side of the shroud segment 15. A single cooling air channel 17, which extends in the blade longitudinal direction 25 and can be supplied with cooling air from below via a cooling air inlet 17', is indicated by dot-dashed lines in the interior of the blade 10.

If such a gas turbine blade—as shown in FIG. 1—has an elongated design and has thin blade walls, the small cross sections between the (single) core and the mold make it difficult, during the production by casting, to introduce sufficient material from the blade root into the mold and upward into the tip, so that the relatively solid shroud segment is produced flawlessly and without cavities or porosities.

In the past, this problem has been solved either by additionally feeding material into the mold from the blade tip or by providing a second feed line on the surface of the airfoil. Such multiple feed lines are rather undesirable, however, because they can result in differently solidifying regions which impair the mechanical stability and uniformity of the mechanical properties.

SUMMARY

The present disclosure is directed to a method for producing a blade, by casting, for a gas turbine. The blade includes an elongate airfoil, which extends in a blade longitudinal direction, merges into a blade root at a lower end, has a shroud segment at a blade tip and is pervaded at least by one cooling air channel running in a blade longitudinal direction from the blade root to the blade tip. The method includes providing a mold and feeding a blade material exclusively from the blade root into the mold, during casting of the blade. The method also includes forming the at least one cooling air channel, during the casting of the blade, by using at least one core body, which is provided, at the blade tip, with a local casting cross section increasing element.

The present disclosure is also directed to a blade for a gas turbine. The blade includes an elongate airfoil, which extends in a blade longitudinal direction, merges into a blade root at a lower end, has a shroud segment at a blade tip and is pervaded at least by one cooling air channel running in a blade longitudinal direction from the blade root to the blade tip. The blade is produced by a method, which includes providing a mold and feeding a blade material exclusively from the blade root into the mold, during casting of the blade. The method also includes forming the at least one cooling air channel, during the casting of the blade, by using at least one core body, which is provided, at the blade tip, with a local casting cross section increasing element

BRIEF DESCRIPTION OF THE DRAWINGS

The invention will be explained in more detail below on the basis of exemplary embodiments in conjunction with the drawing. All the elements which are not required for the direct understanding of the invention have been omitted. Identical elements are provided with the same reference numerals in the various figures.

DETAILED DESCRIPTION OF THE PREFERRED EMBODIMENTS

Introduction to the Embodiments

Figure 1:
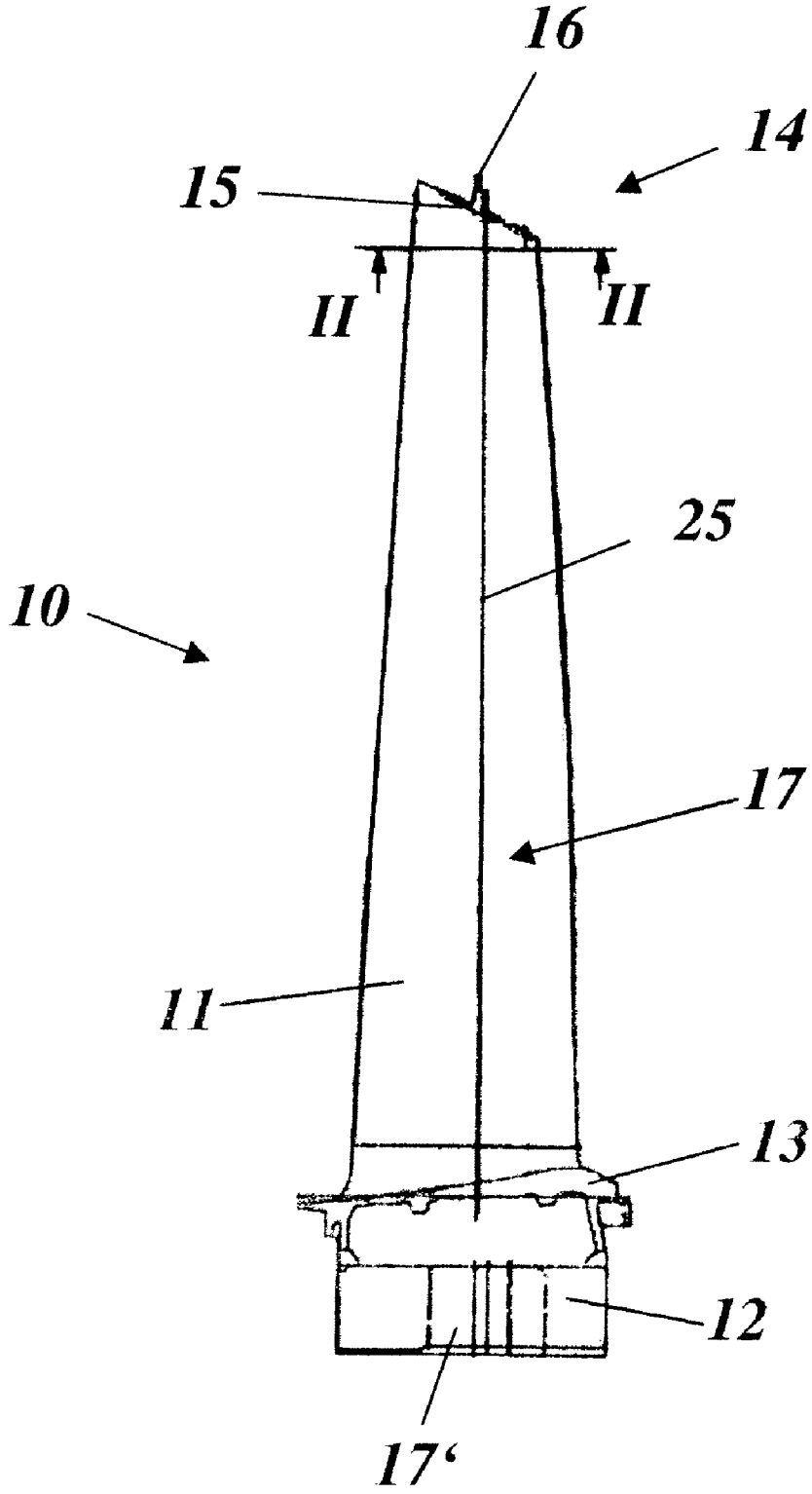
FIG. 1 shows a side view of a gas turbine blade, as is particularly suitable for the use of the invention.

It is therefore an object of the invention to specify a method for producing an elongate, thin-walled gas turbine blade by casting, which avoids the disadvantages of known methods and is distinguished, in particular, by the flawless formation of the shroud segment while ensuring uniform properties of the blade as a whole.

The object is achieved by the entirety of the features of claim 1. It is preferable for the method according to the invention that, during the casting of the blade, the blade material is fed exclusively from the blade root into the mold provided therefor, and that the cooling air channel is formed during the casting of the blade by using a core body, which is provided, at the blade tip, with a local casting cross section increasing element.

Owing to the (local) increase in the casting cross section at the blade tip, it is possible for more material to pass into the blade tip and thus into the shroud segment and, if appropriate, ribs within a specific time interval during the casting. This has the effect that a remedy is thereby provided against possible porosity in the shroud segment and against the risk of excessively rapid solidification of the casting material at the awkward transition to the shroud segment; at the same time, the geometrical dimensions of the blade can be adhered to more accurately.

According to one configuration of the invention, the element that increases the available casting cross section comprises at least one trench running in the blade longitudinal direction of the core body. The casting cross section increasing element preferably comprises two trenches running in the blade longitudinal direction of the core body, one of the trenches is arranged on a side of the core body which faces toward the suction side of the blade and the other of the trenches is arranged on a side of the core body which faces toward the pressure side of the blade.

The casting operation is particularly beneficial if the trenches each have a depth profile which resembles the course of a ski-jumping slope. This has the effect that the casting material can flow more successfully in the region of the awkward zone. The two trenches are preferably arranged on the core body so as to be offset with respect to one another in the transverse direction.

Another configuration is distinguished by the fact that the trenches have a rounded cross-sectional profile, preferably a cross-sectional profile which is in the form of a circular arc.

The blade according to the invention for a gas turbine comprises an elongate airfoil which extends in a blade longitudinal direction, merges into a blade root at the lower end, has a shroud segment at the blade tip and is pervaded by a single cooling air channel running in the blade longitudinal direction from the blade root to the blade tip, wherein the blade is produced by the method according to the invention.

In one configuration of the blade, on the inner sides of the pressure-side and of the suction-side blade wall, the blade is provided, at the blade tip, with a rib running in the blade longitudinal direction, wherein the two ribs are arranged so as to be offset with respect to one another in the transverse direction and each have a rounded cross-sectional profile, preferably a cross-sectional profile which is in the form of a circular arc.

DETAILED DESCRIPTION

Figure 2:
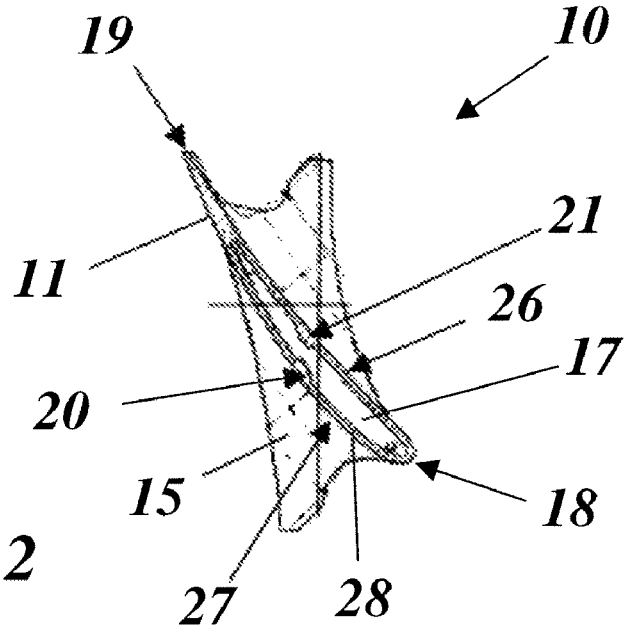
FIG. 2 shows a cross section through a blade of the type shown in FIG. 1 along the plane II-II therein, according to a preferred exemplary embodiment of the invention.
Figure 3:
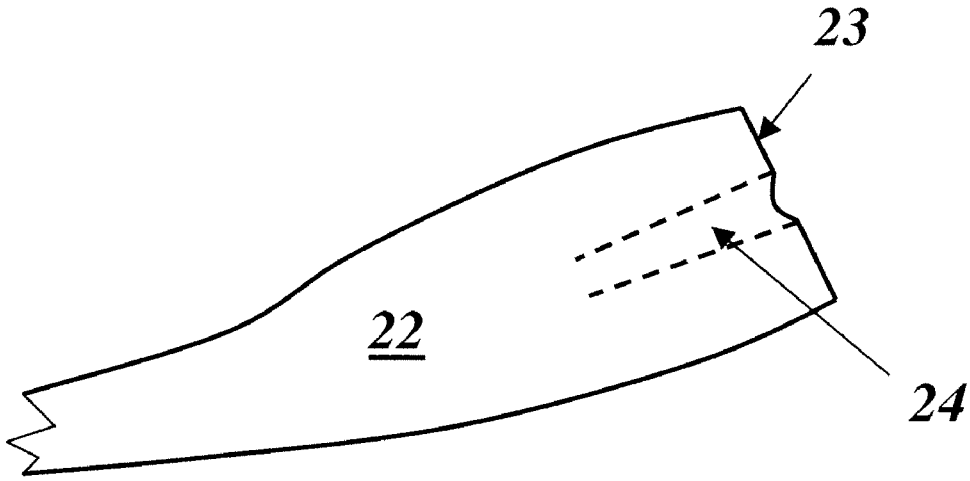
FIG. 3 shows a core body for the method according to the invention.

In order, by the method according to the invention, to feed more material from the blade root 12 into the blade tip 14 with the relatively solid shroud segment 15 to be formed there, despite thin blade walls (28 in FIG. 2), the cooling air channel 17 is produced in the mold by using a single core body 22 as shown in FIG. 3, which is provided with trenches 24 running in the blade longitudinal direction 25 at its upper end 23, which corresponds to the blade tip 14, on the opposing broad sides which face toward the pressure side (26 in FIG. 2) and the suction side (27 in FIG. 2) of the airfoil 11. In the blade longitudinal direction 25, the trenches 24, of which only one can be seen and is indicated by dashed lines in FIG. 3, have a depth profile which corresponds to the height profile of a "ski-jumping slope", i.e. has a long, straight portion with a subsequent, briefly curved portion ("ski-jumping platform").

The two trenches 24 are arranged on the core body 22 so as to be offset with respect to one another in the transverse direction. As a result, during the casting the ribs 20, 21 which can be seen in cross section in FIG. 2 are formed on the inner sides of the blade walls 28, and are offset in the transverse direction between the leading edge 18 and the trailing edge 19. The trenches 24 and also the ribs 20, 21 formed as a result have a rounded cross-sectional profile, preferably a cross-sectional profile which is in the form of a circular arc. This configuration of the profiles ensures that material is fed in an optimized manner into the region of the blade tip 14, without the flow properties in the cooling air channel 17 being considerably impaired. Owing to the ribs 20, 21, the heat transfer surface between the cooling air and the blade wall 28 is additionally enlarged and the cooling of the blade walls 28 is improved thereby.

If the blade has a plurality of individual or intercommunicating cooling channels which run in the longitudinal direction, the ramifications of the core body induced as a result in the longitudinal direction toward the blade tip each have corresponding trenches, which fulfill the final purpose described above.

Overall, the following advantages are obtained with the invention:

The dimensional stability of the mold is supported.

The accuracy in the dimensions of the blade is improved.

The metallurgical and dimensional quality of the airfoil, the shroud segment and the shroud rib are improved.

List Of Reference Numerals

10 Blade (gas turbine)
11 Airfoil
12 Blade root
13 Platform
14 Blade tip
15 Shroud segment
16 Rib
17 Cooling air channel
17' Cooling air inlet
18 Leading edge
19 Trailing edge
20, 21 Rib
22 Core body
23 Upper end
24 Trench
25 Blade longitudinal direction
26 Pressure side
27 Suction side
28 Blade wall

What is claimed is:

1. A method for producing a blade, by casting, for a gas turbine, said blade comprising an elongate airfoil which extends in a blade longitudinal direction, merges into a blade root at a lower end, has a shroud segment at a blade tip and is pervaded at least by one cooling air channel running in a blade longitudinal direction from the blade root to the blade tip, the method comprising:

providing a mold;

feeding a blade material exclusively from the blade root into the mold, during casting of the blade; and forming the at least one cooling air channel, during the casting of the blade, by using at least one core body, which is provided, at the blade tip, with a local casting cross section increasing element.

2. The method as claimed in claim 1, wherein the casting cross section increasing element comprises at least one trench running in the blade longitudinal direction of the at least one core body.

3. The method as claimed in claim 2, wherein the casting cross section increasing element comprises two trenches running in the blade longitudinal direction of the at least one core body, one of the trenches is arranged on a side of the at least one core body which faces toward a suction side of the blade and the other of the trenches is arranged on a side of the at least one core body which faces toward a pressure side of the blade.

4. The method as claimed in claim 3, wherein the trenches each have a depth profile having a long, straight portion with a subsequent, briefly curved portion.

5. The method as claimed in claim 3, wherein the two trenches are arranged on the at least one core body so as to be offset with respect to one another in a transverse direction, one of the trenches being arranged on the side of the at least one core body which faces toward the suction side of the blade and the other of the trenches being arranged on the side of the at least one core body which faces toward the pressure side of the blade.

6. The method as claimed in claim 3, wherein the trenches have a rounded cross-sectional profile.

* * * * *